United States Patent [19]

Romanelli et al.

[11] 4,402,663

[45] Sep. 6, 1983

[54] AUTOMATIC IGNITION AND FLAME DETECTION SYSTEM FOR GAS FIRED DEVICES

[75] Inventors: Pat Romanelli, Harrington Park, N.J.; Kenneth Peters, Billerica, Mass.

[73] Assignee: Ram Products, Inc., Northvale, N.J.

[21] Appl. No.: 258,388

[22] Filed: Apr. 28, 1981

[51] Int. Cl.[3] ..... F23N 5/00

[52] U.S. Cl. ..... 431/66; 431/71; 431/72; 361/264

[58] Field of Search ..... 431/6, 12, 66, 67, 71, 431/72, 73; 361/264, 265, 266

[56] References Cited

U.S. PATENT DOCUMENTS

| | | | |
|---|---|---|---|
| 3,620,659 | 11/1971 | Fox | 431/66 |
| 3,649,154 | 3/1972 | Palmer et al. | 431/66 X |
| 3,784,351 | 1/1974 | Wolfe et al. | 431/66 |
| 4,188,181 | 2/1980 | Rippelmeyer et al. | 431/66 |
| 4,289,476 | 9/1981 | Visos et al. | 431/66 |
| 4,298,355 | 11/1981 | Riordan et al. | 431/67 X |

*Primary Examiner*—Samuel Scott

*Assistant Examiner*—Randall L. Green

*Attorney, Agent, or Firm*—Edward F. Levy

[57] ABSTRACT

Improved automatic ignition system (10) for gas fired devices such as boilers, clothes dryers, ranges, and the like. The system (10) is of the type including a variable resistance ignition means (16) having a particular temperature characteristic disposed in proximity to the burner (14) for igniting gas flowing therethrough when the ignition means (16) is energized. The improved system includes detection means (12) for repeatedly measuring the resistance of the ignition means (16) and for comparing such measurements, and activating means (12) for activating the gas valve opening means (56) to open the valve (60) when the detection means (12) establishes that the ignition means (16) is in the portion of its temperature characteristic where the temperature thereof is sufficient to ignite gas. The preferred system (10) also includes means (12) for detecting a flameout, means (22) for detecting a low gas pressure condition, and visual means (28) for indicating system status as well as the existence and nature of system malfunctions.

17 Claims, 10 Drawing Figures

DIAGNOSTIC
L0
L1
L2
L4
CD 4511
820Ω
7-SEGMENT DISPLAY
MONSANTO MAN 74A
cathode
Vcc
R17 51k
CK1
C7 100pf 50v
9V
D1
IC3d
1/4 LM339
R11 100k
D7
R18 2.7k
Vraw
24VAC
K2
D8 IN4001
Q2 QN6816
PILOT VALVE
MOV1 V47MA2B
D0
RESET
IN914
C6 .1μf
D5 IN4001
R14 470Ω
C5 100μf 50v
D10 IN4001
D9 IN4001
C8 100μf 25v
Q3 92PU45
R13 10Ω
K3
ESSEX 64-612131-103 12 VOLT COIL 1600Ω COIL
SECONDARY VALVE
MOV2 V47MA2B

AUTOMATIC IGNITION AND FLAME DETECTION SYSTEM FOR GAS FIRED DEVICES

TECHNICAL FIELD

This invention pertains to ignition systems for gas fired devices, and in particular to automatic ignition and heat detection systems for such devices.

BACKGROUND ART

In many conventional gas fired appliances, such as boilers, clothes dryer, ovens and the like, it is customary to provide heat by igniting gas emanating from a main burner. Commonly, gas flows through the main burner when the device is activated, the gas being ignited by a nearby pilot flame which is constantly burning. Recognizing the inefficiency and danger of a constantly burning pilot flame, automatic ignition systems which rely upon heat from a resistive element to ignite the main burner have been substituted for constantly burning pilot systems, the resistive element being energized only when the device calls for heat. In such systems, it is known to employ a silicon carbide resistive element having a negative temperature characteristic (i.e. the resistance of silicon carbide decreases with increasing temperature) as the igniter. One such prior art system is described in U.S. Pat. No. 3,282,324, the contents of which are hereby incorporated by reference in their entirety.

In the system disclosed in U.S. Pat. No. 3,282,324, a solenoid activated gas valve is employed, the solenoid winding being in a circuit with the igniter element. Because silicon carbide has a negative temperature characteristic, when the device calls for heat, current flow through the igniter heats the igniter thereby dropping its resistance. This continues until current flow through the circuit incorporating the solenoid winding increases sufficiently to energize the solenoid and open the gas valve.

To close the gas valve in the event of a flameout, the system includes a circuit which deenergizes the igniter element after the gas valve is opened. The igniter element then operates as a heat detector, the gas valve being closed if current flow through the igniter element drop below a predetermined value considered indicative of a sufficient drop in temperature to confirm a flameout.

It will be apparent that in both the ignition and heat detection modes, the system disclosed in U.S. Pat. No. 3,282,324 is based on the assumption that current flow through the igniter element, and hence its resistance, is an accurate indication of the igniter element temperature. Unfortunately, this assumption ignores the reality that the resistance/temperature characteristic for different silicon carbide igniter elements varies from one igniter element to the next. That is, one igniter element might display one temperature at a particular resistance, while another igniter element might display a quite different temperature at that resistance. Accordingly, relying on a predetermined igniter element resistance level as an indication that its temperature is sufficient to ignite gas results in a potentially inaccurate system. Furthermore, the time required for the system discussed in the patent to open and close the gas valve is relatively slow.

Another prior art system is disclosed in U.S. Pat. No. 3,933,419, the contents of which are also hereby incorporated by reference in their entirety. In the system disclosed in this patent, a heat sensing plate comprised of a magnetic alloy having a predetermined Curie temperature is employed to determine when the temperature of the igniter element is sufficient to ignite gas. In particular, the heat sensing plate exhibits magnetic properties at room temperature which are sufficient to attract a permanent magnet in a circuit operatively connected to the gas valve. As long as the permanent magnet is attracted to the plate, the valve remains closed. However, as the plate is heated by current flow through the igniter element, its Curie temperature is eventually reached at which point the plate loses its ability to attract the magnet. As a result, the magnet moves away from the plate under the urging of a spring whereupon the gas valve is opened. As usual, shortly after the gas valve is opened, the igniter element is deenergized, and as long as the heat of the flame keeps the temperature of the igniter element sufficiently high to maintain the plate above its Curie temperature, the gas valve remains open. In the event of a flameout, the temperature in the vicinity of the igniter element drops, and hence the temperature of the heat sensing plate also drops. As a result, the plate again acquires magnetic properties sufficient to attract the permanent magnet and close the gas valve.

It will be apparent, therefore, that the system disclosed in U.S. Pat. No. 3,933,419 relies upon the point at which the magnetic plate loses its magnetic attractability as an accurate indication of the temperature of the plate, and hence of the igniter element. This system is, therefore, based on the questionable assumption that the permanent magnet and heat sensing plate can be manufactured in commercial quantities with sufficiently uniform magnetic properties to insure that the gas valve will not be prematurely opened or closed. Furthermore, the response time of this system is also relatively slow.

DISCLOSURE OF THE INVENTION

According to the present invention I have developed an improved automatic ignition system for gas fired devices of the type including a resistance type igniter. The improved ignition system is capable of determining when the igniter is sufficiently hot to ignite gas, taking into account that different igniters have different temperature characteristics. Preferably, this is accomplished by incorporating in the system a microcomputer operatively connected to the igniter, the microcomputer being programmed to repeatedly measure the resistance of the igniter and to compare successive measurements. In this manner, the microcomputer is capable of determining when the igniter has reached the flattened portion of its temperature/resistance curve where the igniter is known to be sufficiently hot to ignite gas.

Preferably, the microcomputer is programmed to conduct two separate tests to confirm that the igniter has reached the flattened portion of its temperature characteristic. In the first test, referred to hereinbelow as the "warm" test, the microcomputer first establishes a threshold based on the resistance of the igniter element prior to energization. The igniter is then energized whereupon the microcomputer, after a predetermined delay, again measures the resistance of the igniter. If the new reading is below the threshold, the warm test is passed, as this indicates that the igniter is in the relatively steep portion of its temperature characteristic where increases in temperature result in relatively large decreases in resistance. If the warm test is not passed, the microcomputer, again after a predetermined delay, remeasures the igniter resistance for comparison with the threshold. This continues until either the warm heat is passed or a predetermined time interval expires. In the latter event, the system enters a FAULT mode to be described hereinafter. In the second test, referred to as the "hot" test, the microcomputer compares successive resistance measurements until the difference between successive measurements is below a predetermined maximum. This confirms that the igniter has reached the flattened portion of its temperature characteristic where its resistance changes relatively sightly with increasing temperatures. As noted, in the flattened portion of the temperature characteristic, the igniter is sufficiently hot to ignite gas. Upon confirming that the igniter has reached ignition temperature, the microcomputer is programmed to open the gas valve thereby effecting ignition as the gas passes through the burner in the vicinity of the igniter. The igniter element is then deenergized.

In the preferred system, the microcomputer is also programmed to detect a flameout. This is also preferably accomplished by comparing successive resistance measurements of the igniter. Specifically, in the flame detection mode, the microcomputer is programmed to conduct two separate tests, each of which is independently capable of confirming a flameout. In the first test, referred to hereinbelow as the threshold or level test, the microcomputer establishes a resistance threshold based on the resistance of the igniter just prior to ignition. Once the igniter is deenergized after ignition, the microcomputer continuously monitors the igniter resistance at regular intervals. If the igniter resistance exceeds the threshold, a flameout is confirmed, as this indicates that the temperature in the vicinity of the igniter is no longer sufficient to maintain the igniter on the flattened portion of its temperature characteristic. In the second test, referred to below as the "rate" test, the microcomputer compares successive resistance measurements and determines if the rate of change of the igniter resistance exceeds a predetermined rate. The rate is selected such that, if exceeded, a flameout is confirmed. In the event of a flameout, the microcomputer is preferably programmed for corrective action.

The preferred system also includes means for confirming that the gas pressure is above a predetermined minimum considered safe. For this purpose, the system preferably includes two independently operable, serially arranged gas valves. A conduit having a pair of spaced apart electrically conductive contacts at one end thereof communicates with the flow path between the valves, and a conductive member is disposed for sliding movement in the conduit. When the gas valve on the inlet side of the conduit is opened, gas flows into the conduit and, if gas pressure is sufficient, urges the conductive member upward until it completes an electrical circuit between the contacts. This is detected by the microcomputer, which is operatively connected to the contacts. If gas pressure is low, the electrical circuit between the contacts will not be completed by the conductive member, and this condition will also be detected by the microcomputer. In the event of a low gas pressure condition, the microcomputer is preferably programmed for corrective action. Preferably, the microcomputer monitors gas pressure both before and after ignition.

Another feature of the preferred system is the provision of means for indicating the status of the system and the nature of any malfunction. Preferably, such means comprises a self-powered module having a digital display thereon, the module being removably connectable to the microcomputer. When the module is connected to the microcomputer, the number on the digital display indicates the existence and nature of the particular system malfunction, or simply the status of the system. For example, the different numbers on the display may be utilized to indicate a faulty igniter, faulty valve circuitry, flameout, failure of the igniter to reach ignition temperature, etc. It is presently contemplated that the module will be utilized by service personnel during system inspection and repair.

The use of a microcomputer to control system operations also results in a reduction of system response time and therefore greater overall fuel efficiency and safety. Also, by reducing the number of moving parts, system reliability is increased. The preferred system also preferably includes means for modifying the programming of the microcomputer for particular applications, preferably by ungrounding specific inputs to the microcomputer.

The above as well as further features and advantages of the preferred automatic fuel ignition and detection system in accordance with the present invention will be more fully apparent from the following detailed description and annexed drawings of the presently preferred embodiment. In the following description the preferred system is described for use in connection with a gas-fired boiler. However, it will be apparent to those skilled in the art that it may be utilized for controlling a a wide range of gas-fired devices, such as domestic ranges, dryers, and the like, and that the system may be retrofitted on such gas-fired devices.

BEST MODE FOR CARRYING OUT THE INVENTION

Figures 1, 2:
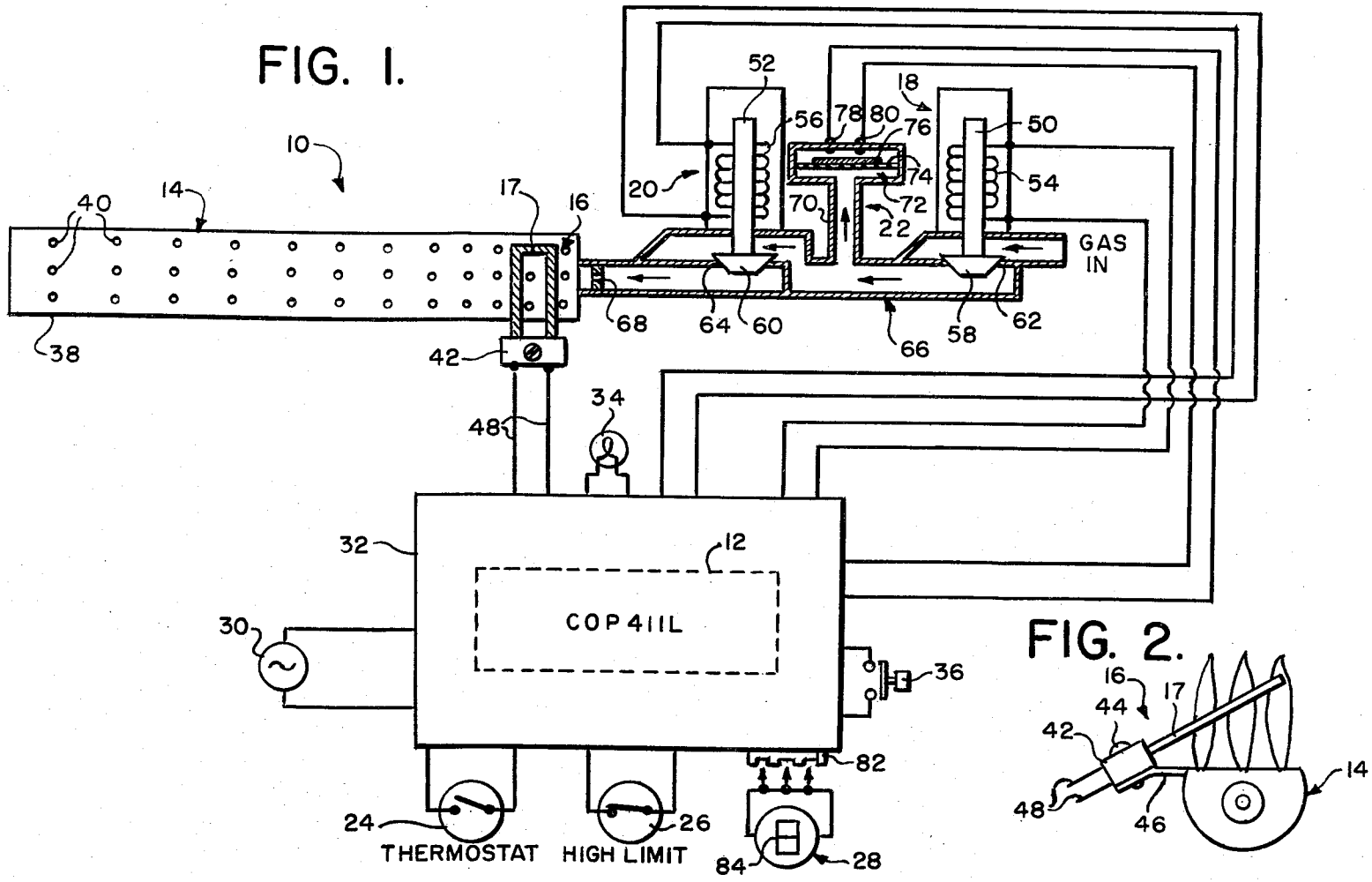
FIG. 1 is a diagrammatic illustration of the preferred automatic ignition and heat detection system in accordance with the present invention.
FIG. 2 is an elevational view illustrating the preferred manner for supporting the igniter element in proximity to the burner.

Referring initially to FIG. 1 of the drawings, the presently preferred embodiment of the fuel ignition and heat detection system in accordance with the present invention is generally designated by the reference number 10. As shown, the system 10 preferably includes a microcomputer integrated circuit chip 12, such as a COP411L, manufactured and distributed by National Semiconductor Corp., which conventionally contains a microcprocessor, associated input/output devices, a read only memory and random access memory all in one chip. Such a microcomputer chip 12 is conventionally programmable in the associated machine language used with the chip such as, by way of example, what is termed COP assembly language.

The other components of the preferred system 10 illustrated in FIG. 1, the functions of which will be explained in greater detail hereinafter, are a burner 14, an igniter 16, a redundant valve arrangement comprised of a pilot valve assembly 18 and a secondary valve assembly 20, a pressure sensitive switch 22, a thermostat control 24, a high limit switch 26, a diagnostic plug-in module 28, and a power source 30. As diagrammatically illustrated in FIG. 1, the microcomputer 12 is supported within a module or housing 32. The housing 32 also contains the circuitry interfacing the microcomputer 12 with the other components of the system 10. This interfacing circuitry will be described in greater detail hereinafter with reference to FIG. 3, wherein the system 10 is schematically illustrated. Mounted on the housing 32 are an indicator light 34 and a reset switch 36, both of which are also connected to the microcomputer 12. The functions of the light 34 and switch 36 will also be explained in greater detail hereinafter. Power is supplied to the housing 32 and from there to the various components in the system 10 by a power source 30 which preferably comprises a standard 117 volt AC power line. The housing 32 is preferably mounted, as by screws, on a control panel adjacent the controlled apparatus, which may be a boiler.

The burner 14 is conventional and may comprise, for example, a burner of the type used in gas fired boilers. As usual, it comprises a tubular member 38 having a plurality of apertures 40 therein. Referring to FIGS. 1 and 2, the igniter 16 comprises an element 17 secured at one end in an insulating block 42 which is mounted, as by screw 44, on a bracket 46 extending from the burner 14. In this fashion, the element 17 is supported near the burner 14 so that the element can perform its dual functions of igniting the gas flowing from the burner and sensing the heat of the resulting flame. A pair of leads 48 extending from the outer end of the insulating block 42 connect the igniter element 17 with the module 32.

Igniter elements 17 suitable for incorporation in the system 10 are commercially available. The element 17 is comprised, for example, of silicon carbide, which has a negative temperature characteristic, i.e. the resistance of silicon carbide decreases with increasing temperature. Generally, the igniter element 17 is commercially available as a package including the insulating block 42 and leads 48. By way of example, the model no. 767A silicon carbide igniter manufactured by the White Rodgers division of Emerson Electric Company is suitable for incorporation in the system 10.

Those skilled in the art will appreciate that the temperature characteristic varies from one igniter element to the next. That is, one igniter element will exhibit a particular resistance at a temperature of 100° F., while another igniter element may exhibit a different resistance at that temperature. Accordingly, for an automatic ignition system to be compatible with different igniter elements, it must be able to compensate for these differences. As will be explained in greater detail hereinafter, the system 10 is fully capable of doing so.

Before entering the burner 14, gas first flows through the redundant valve arrangement comprised of pilot valve assembly 18 and secondary valve assembly 20, such as the redundant valve arrangement model no. 36C84 manufactured by the White Rodgers division of Emerson Electric Co. As shown, the valve assemblies 18 and 20 are preferably of the solenoid variety and thus include cores 50, 52 and actuating coils 54, 56, respectively. As will be more fully apparent from FIG. 3, the coils 54, 56 are actuated by relays supported within the housing 32 and interfaced with the microcomputer 12. As shown, valves 58 and 60 are connected, respectively, to the cores 50, 52. The valves seats 62, 64 for the valves 58, 60 are formed in a preferably casted chamber 66 which defines the flow path for the incoming gas. It will be apparent from FIG. 1 that before incoming gas enters the burner 14, it must first flow through the openings defined by both of the valve seats 62, 64. In FIG. 1, the valves 58, 60 are shown in their closed positions wherein gas flow through the chamber 66 to the burner 14 is blocked. When the valves 58 and 60 are opened, gas flows into the burner 14 through a metered orifice 68.

The pressure sensitive switch 22 includes a conduit 70 which communicates with the gas flow path defined by the chamber 66 between the valve seats 62 and 64. The conduit 70 opens into a larger chamber 72 in which a diaphragm 74 is slidably supported. The diaphragm 74 has a conducting element 76 secured thereon which connects the contacts 78, 80 when the diaphragm 74 is in its uppermost position. The significance of this will be more fully apparent hereinafter. At this point, suffice it to say that the diaphragm will assume its uppermost position whenever the valve 58 is open and gas pressure is above a predetermined minimum considered safe.

The thermostat 24 may be of the type conventionally used for regulating the activation and deactivation of gas fired boilers and the like. As will be explained in greater detail hereinafter, when the thermostat 24 calls for heat, the system 10 is activated and the ignition sequence is commenced. The high limit switch 26 is a safety feature comprising a temperature sensitive switch preferably disposed to sense the temperature in the boiler chamber. As will be more fully explained hereinafter, if, for example, the temperature in the chamber is too hot, which may, for example, be caused by a fan malfunction, the high limit switch 26 opens, whereupon the microcomputer 12 automatically closes the valves 58 and 60 thereby blocking the further flow of gas to the burner 14.

The diagnostic plug-in module 28, which is connectable to the housing 32 via the receptacle 82, contains a digital display 84. As will be explained hereinafter, when the plug-in module 28 is connected to the housing 32, the display 84 provides information indicative of the status of the system 10, including the existence and nature of a malfunction, if any. The presence of a fault or malfunction in the system 10 is also indicated by the lighting of the indicator light 34.

Figure 3A:
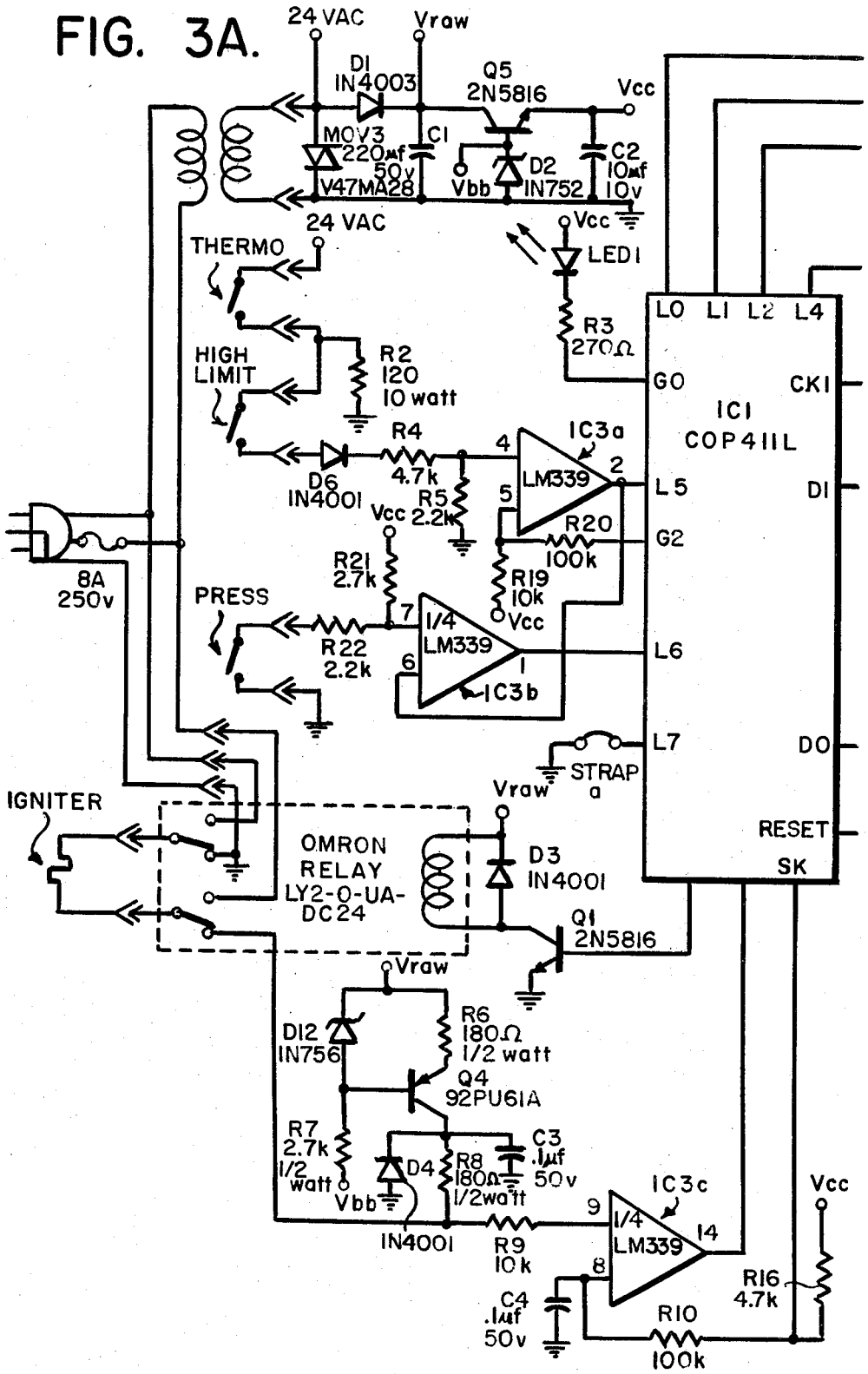
FIGS. 3A and 3B schematically illustrate the preferred system shown in FIG. 1.
Figure 3B:
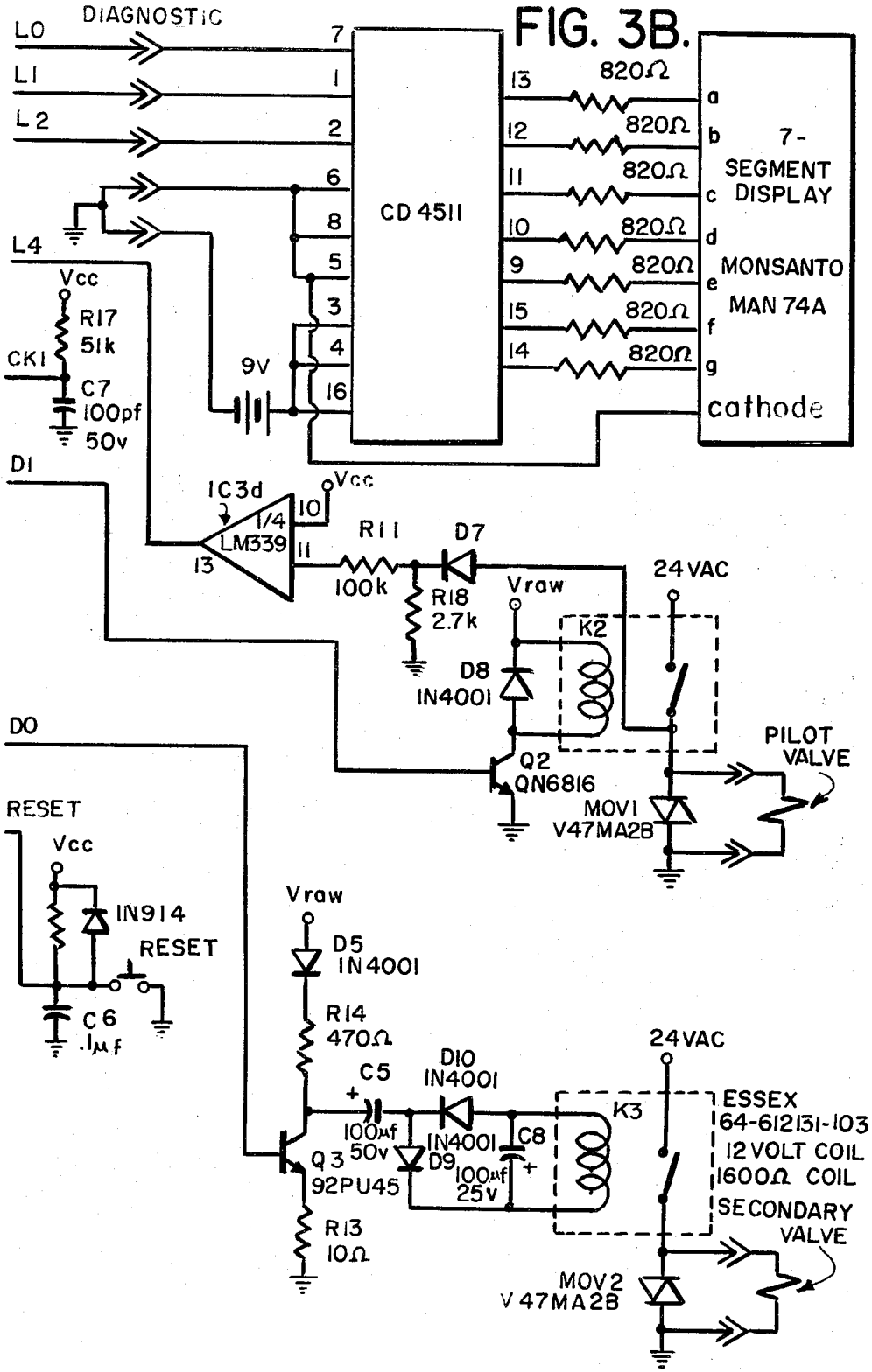

A schematic representation of the system 10 is illustrated in FIG. 3 wherein typical component values and circuit elements are indicated. A detailed description of the schematic is deemed unnecessary, as the operation of the illustrated circuit will be fully apparent to the skilled art worker from this description. As regards the microcomputer 12, and as previously noted, it is preferably a conventional COP411L microcomputer of the type distributed by National Semiconductor Corp., which is conventionally programmed in COP assembly language. The preferred control program listing for the microcomputer 12 for operating the system 10 is as follows:

```
                TITLE  FURNACE,'NOVEMBER 4,1980'

      0009   COUNT   =       0,9
      000A   LPORT   =       0,10
      001B   TEST    =       1,11
      000D   CNTL    =       0,13
      000E   DELTAL  =       0,14
      000F   DELTAH  =       0,15
      0019   GPORT   =       1,9
      001A   DELL1   =       1,10
      001C   T12     =       1,12
      001E   RESL    =       1,14
      001F   RESH    =       1,15
      0029   ACTST   =       2,9
      002A   STATUS  =       2,10
      002B   ACTST4  =       2,11
      002C   ACTST5  =       2,12
      002D   ACTST6  =       2,13
      002E   STKL    =       2,14
      002F   STKH    =       2,15
      0039   DEL     =       3,9
      003A   TIMCNT  =       3,10
      003D   SECOND  =       3,13
      003E   CONSTL  =       3,14
      003F   CONSTH  =       3,15

000 00               CLRA                      ;ROM 0 MUST BE 0
                ;
                ; INITIALIZE FLAMEOUT COUNTER TO 3
                ;
001 29               LBI     STATUS
002 79               STI1    9
003 B7               JSRP    STATUP
004 0E               LBI     DELTAH
005 77               STII    7
006 0E               LBI     DELTAH
007 333A             OMG                       ;TURN OFF LED
009 3365             LEI     5
00B 695A             JSR     TIME
00D 08          INIT:LBI     COUNT             ;INIT COUNT TO 2
00E 72               STII    2

                ; OUTPUT STATUS = 1 TO FAULT ANALYZER

00F 29          STATS1: LBI  STATUS
010 79               STI1    9
011 B7               JSRP    STATUP            ;UPDATE STATUS

                ; RAISE THERMOSTAT THRESHOLD FOR HYSTERESIS

012 18               LBI     GPORT             ;THERMOSTAT HYSTERESIS
013 77               STI1    7
014 18               LBI     GPORT
015 333A             OMG

                ; MONITOR VITALS: PILOT VALVE, THERMOSTAT

017 82          WAITLP: JSRP TSTAC             ;TEST PILOT VALVE
018 2A               LBI     ACTST4
019 13               SKMBZ   3
01A 61BD             JMP     STATS6            ;PILOT VALVE STUCK
01C 2B          PILTOK: LBI  ACTST5            ;TEST THERMOSTAT INPUT
01D 13               SKMBZ   3
01E E0               JP      STATS2
01F CD               JP      INIT              ;HEAT NOT REQUIRED NOW
```

```
67                  ; PREPURGE DELAY,  OUTPUT STATUS = 2 TO FAULT ANALYZER
68
69  020 1A      STATS2: LBI     TEST            ;TEST 30 SECOND STRAP
70  021 13              SKMBZ   3
71  022 EC              JP      STATS3
72  023 29              LBI     STATUS
73  024 7A              STII    10
74  025 B7      PURGE:  JSRP    STATUP          ;UPDATE STATUS
75  026 0C              LBI     CNTL            ;INIT COUNT FOR DELAY
76  027 78              STII    8
77  028 70              STII    0
78  029 77              STII    7
79  02A 695A            JSR     TIME
80
81                  ; BEGIN IGNITION PROCEEDURE
82
83  02C 29      STATS3: LBI     STATUS
84  02D 73              STII    3
85  02E 29              LBI     STATUS
86
87                  ; LOWER THERMOSTAT THRESHOLD FOR HYSTERESIS
88
89  02F 333A            OMG                     ;OUTPUT HYSTERESIS
90  031 7B              STII    11
91  032 B7              JSRP    STATUP          ;UPDATE STATUS
92  033 6B26            JSR     ATOD            ;MEASURE IGNITER
93
94                  ; TEST IGNITER FOR SHORT
95
96  035 3D              LBI     CONSTL
97  036 70              STII    0
98  037 7C              STII    12
99  038 91              JSRP    ADRESC          ;TEST FOR RES < 40
100 039 20              SKC
101 03A 61B9            JMP     STATS7
102
103                 ; TEST VITALS BEFORE CONTINUING
104
105 03C 0D      TSTGAS: LBI     0,14            ;TURN ON UPSTREAM SOL
106 03D 333E            OBD
107 03F 6856            JSR     ONESEC          ;DELAY 1 SECOND

108 041 82              JSRP    TSTAC
109                                             ;TEST THERMOSTAT INPUT
110 042 13              SKMBZ   3
111 043 6047            JMP     TSTG
112 045 613C            JMP     OFFGAS
113 047 2C      TSTG:   LBI     ACTST6          ;TEST GAS PRESSURE
114 048 13              SKMBZ   3
115 049 6052            JMP     TURNON          ;PRESSURE OK
116
117                 ; LOW GAS PRESSURE.  INDICATE STATUS AND DO PURGE DELAY
118
119 04B 0F      STATS5: LBI     0,0
120 04C 333E            OBD                     ;TURN OFF VALVES
121 04E 29              LBI     STATUS          ;OUTPUT 5 TO ANALYZER
122 04F 7D              STII    13
123 050 6025            JMP     PURGE
124
125                 ; ALL VITALS INDICATE GO.  SUBTRACT 20 FROM R-COLD
126
127 052 2D      TURNON: LBI     STKL            ;SET STACK TO F2
128 053 70              STII    0
129 054 7E              STII    14
130 055 99              JSRP    ADRESS
```

```
131
132                ; SET 1 MINUTE TIMER
133
134 056 39                LBI     TIMCNT          ;INIT TIMEOUT COUNTER
135 057 7D                STII    13
136 058 71                STII    1
137
138                ; SET SLOPE CONSTANT FOR HOT IGNITER
139
140 059 3D         COPY3: LBI     CONSTL          ;SET SLOPE CONSTANT
141 05A 75                STII    5
142 05B 7F                STII    15
143 05C 91                JSRP    ADRESC
144
145                ; DECREMENT 1 MINUTE TIMER, IF TIMED OUT, STATE = 7
146
147 05D 39         DECTM: LBI     TIMCNT          ;DEC TIMEOUT COUNTER
148 05E 32                RC
149 05F 00                CLRA
150 060 40                COMP
151 061 30                ASC
152 062 44                NOP
153 063 04                XIS     0
154 064 00                CLRA
155 065 40                COMP
156 066 30                ASC
157 067 44                NOP
158 068 06                X       0
159 069 20                SKC
160 06A 61B9              JMP     STATS7          ;IGNITER PROBLEM
161
162                ; TURN ON IGNITER FOR TWO SECONDS
163
164 06C 336D              LEI     13              ;TURN ON IGNITER
165 06E 6960              JSR     TWOSEC
166 070 3365              LEI     5               ;TURN OFF IGNITER
167 072 6B6E              JSR     DEL16M
168
169                ;MEASURE IGNITER, TEST FOR WARM IGNITER (DID R CHANGE?)
170
171 074 6B26              JSR     ATOD
172 076 AC                JSRP    RSGSTK          ;TEST RES GREATER THAN STK
173 077 20                SKC
174 078 D9                JP      COPY3           ;IGNITER NOT WARM
175
176                ; TEST FOR HOT IGNITER (SLOPE TEST)
177
178 079 A1                JSRP    RSGCNS
179 07A 20                SKC
180 07B 6100              JMP     IGNOK           ;IGNITER IS READY
181 07D 6059              JMP     COPY3           ;IGNITER NOT HOT


182     0080    PAGE   2
183 080 616D   TIMER:  JMP     TIMER1
184 082 6178   TSTAC:  JMP     TSTAC1
185
186                ; IN-LINE A/D ROUTINE
187
188 084 32     AD1:    RC                      ;PREDICT ZERO
189 085 3311           SKGBZ   1               ;TEST COMPARATOR
190 087 22             SC                      ;SO I WAS WRONG
191 088 4F             XAS                     ;OUTPUT TO CAPACITOR
192 089 1D     INC1:   LBI     RESL
193 08A 00     LOP1:   CLRA
```

```
08B 30                ASC
08C 44                NOP
08D 04                XIS     0
08E 8A                JP      LOP1
08F 6300              JMP     RD2

              ; THIS SUBROUTINE ADDS RES TO CONST

091 1D        ADRESC: LBI     RESL
092 32                RC
093 25        ADDLP:  LD      2
094 30                ASC
095 44                NOP
096 24                XIS     2
097 93                JP      ADDLP
098 48                RET

              ; THIS SUBROUTINE ADDS RES TO STK

099 1D        ADRESS: LBI     RESL
09A 32                RC
09B 35        ADDLP1: LD      3
09C 30                ASC
09D 44                NOP
09E 34                XIS     3
09F 9B                JP      ADDLP1
0A0 48                RET

              ; THIS SUBROUTINE COMPARES RES TO CONST

0A1 1D        RSGCNS: LBI     RESL
0A2 22                SC
0A3 25        Q1:     LD      2
0A4 40                COMP
0A5 30                ASC
0A6 44                NOP
0A7 06                X       0
0A8 24                XIS     2
0A9 60A3              JMP     Q1
0AB 48                RET

              ; THIS SUBROUTINE COMPARES RES TO STK

0AC 1D        RSGSTK: LBI     RESL
0AD 22                SC
0AE 35        Q2:     LD      3
0AF 40                COMP
0B0 30                ASC
0B1 44                NOP
0B2 06                X       0
0B3 34                XIS     3
0B4 60AE              JMP     Q2
0B6 48                RET

              ; THIS SUBROUTINE UPDATES THE STATUS OUTPUTS

0B7 29        STATUP: LBI     STATUS
0B8 00                CLRA
0B9 40                COMP
0BA 333C              CAMQ
0BC 48                RET

      0100    PAGE    4
```

```
259                ; TURN ON GAS AND IGNITER FOR ONE SECOND
260
261 100 336D   IGNOK:  LEI     13              ;TURN ON RELAY
262 102 6B8C           JSR     TWOSCV          ;DELAY 1 SECOND
263 104 6B8C           JSR     TWOSCV          ;DELAY 2 SECOND
264 106 3365           LEI     5               ;TURN RELAY OFF
265
266                ; ALLOW IGNITER TO COOL FROM SELF HEAT
267
268 108 6B8C           JSR     TWOSCV
269 10A 3C             LBI     SECOND          ;INITIALIZE AUTO-CORRELATOR
270 10B 71             STII    1
271
272                ;DERIVE DC THRESHOLD
273
274 10C 2D             LBI     STKL
275 10D 74             STII    4
276 10E 71             STII    1
277 10F 99             JSRP    ADRESS          ;DERIVE THRESHOLD
278
279                ; OUTPUT STATUS = 4 TO ANALYZER
280
281 110 29             LBI     STATUS
282 111 7C             STII    12
283 112 B7             JSRP    STATUP
284
285                ; DERIVE RATE THRESHOLD
286
287 113 6B26           JSR     ATOD            ;TAKE READING
288 115 6B81   STATS4: JSR     ONESCV          ;DELAY ONE SECOND
289 117 3D             LBI     CONSTL
290 118 72             STII    2
291 119 70             STII    0
292 11A 91             JSRP    ADRESC
293
294                ; MEASURE IGNITER AND TEST DC THRESHOLD
295
296 11B 6B26           JSR     ATOD            ;MEASURE IGNITER
297 11D AC             JSRP    RSGSTK          ;RES EXCEED THRESHOLD?
298 11E 20             SKC
299 11F 6147           JMP     RETEST
300
301                ; TEST FOR IGNITER EXCEED RATE ON 2 CONSECUTIVE TIMES
302
303 121 A1             JSRP    RSGCNS          ;RES EXCEED RATE TEST?
304 122 20             SKC
305 123 6140           JMP     FLMQ
306
307                ; PASSED RATE TEST, RESET CONSECUTIVE FLAG
308
309 125 3C             LBI     SECOND          ;RESET AUTO-CORRELATOR
310 126 71             STII    1
311 127 70             STII    0
312 128 7F             STII    15              ;TEST FOR SHORTED IGNITER
313 129 91             JSRP    ADRESC
314 12A 20             SKC
315 12B 61B9           JMP     STATS7
316
317                ; MONITOR VITALS
318
319 12D 82     OK2:    JSRP    TSTAC           ;MONITOR STATUS
320 12E 13             SKMBZ   3               ;TEST THERMOSTAT
321 12F F1             JP      NXT1
322 130 FC             JP      OFFGAS
323 131 2C     NXT1:   LBI     ACTST6          ;TEST GAS PRESSURE
324 132 13             SKMBZ   3
```

```
133 F6                JP      NXT2
134 604B              JMP     STATS5
136 2A      NXT2:     LBI     ACTST4          ;TEST PILOT CIRCUIT
137 13                SKMBZ   3
138 6115              JMP     STATS4
13A 61BD              JMP     STATS6          ;MONITOR CIRCUIT FAILURE
13C 6965    OFFGAS:   JSR     TENSEC
13E 600D              JMP     INIT


140 3C      FLMQ:     LBI     SECOND          ;AUTO-CORRELATE
141 05                LD      0
142 5F                AISC    15
143 C7                JP      RETEST
144 06                X       0
145 612D              JMP     OK2

            ; FLAMEOUT! TEST STRAP-A AND FLAMEOUT COUNTER

147 1A      RETEST:   LBI     TEST
148 332E              INL
14A 13                SKMBZ   3               ;TEST STRAP-A
14B CF                JP      STAT7
14C 08                LBI     COUNT
14D 05                LD      0
14E 5F                AISC    15              ;DECREMENT COUNT
14F 61B9    STAT7:    JMP     STATS7          ;FLAMEOUT 3 TIMES
151 06                X       0               ;UPDATE COUNT
152 6965              JSR     TENSEC
154 600F              JMP     STATS1

            ; ONE SECOND DELAY SUBROUTINE

156 0C      ONESEC:   LBI     CNTL
157 74                STII    4
158 7C                STII    12
159 7F      TM:       STII    15
15A 69AB    TIME:     JSR     CYCLE
15C 80                JSRP    TIMER
15D 615A              JMP     TIME
15F 48                RET
160 0C      TWOSEC:   LBI     CNTL            ;TWOSEC DELAY
161 78                STII    8
162 78                STII    8
163 6159              JMP     TM
165 0F      TENSEC:   LBI     0,0
166 333E              OBD
168 0C                LBI     CNTL
169 70                STII    0
16A 70                STII    0
16B 6159              JMP     TM
16D 0C      TIMER1:   LBI     CNTL            ;COUNTER USED FOR DELAYS
16E 22      TM1:      SC                      ;INCREMENT COUNT TO OVERFLOW
16F 00      ADLP1:    CLRA
170 30                ASC
171 44                NOP
172 04                XIS     0
173 616F              JMP     ADLP1
175 20                SKC
176 48                RET
177 49                RETSK                   ;SKIP IF COUNT COMPLETE
178 2A      TSTAC1:   LBI     ACTST4          ;TEST AC INPUTS
179 7C                STII    12              ;INIT RAM
17A 7C                STII    12
17B 7C                STII    12
17C 0C                LBI     CNTL
```

```
17D 7E              STII    14
17E 77              STII    7
17F 7F              STII    15


180 1A     TLP:     LBI     TEST
181 332E            INL
183 01              SKMBZ   0                 ;TEST PILOT VALVE
184 E2              JP      HIGH1
185 2A              LBI     ACTST4
186 4D              SMB     0
187 1A     ALTP1:   LBI     TEST
188 11              SKMBZ   1                 ;TEST THERMOSTAT
189 E5              JP      HIGH2
18A 2B              LBI     ACTST5
18B 4D              SMB     0
18C 1A     ALTP2:   LBI     TEST
18D 03              SKMBZ   2                 ;TEST GAS PRESSURE
18E E8              JP      HIGH3
18F 2C              LBI     ACTST6
190 4D              SMB     0
191 80     ALTP3:   JSRP    TIMER
192 6180            JMP     TLP
194 2C              LBI     ACTST6
195 05              LD      0
196 51              AISC    1
197 70              STII    0
198 2A              LBI     ACTST4
199 05              LD      0
19A 51              AISC    1
19B 70              STII    0
19C 2B              LBI     ACTST5
19D 05              LD      0
19E 51              AISC    1
19F 70              STII    0
1A0 2B              LBI     ACTST5
1A1 48              RET
1A2 2A     HIGH1:   LBI     ACTST4
1A3 47              SMB     1
1A4 C7              JP      ALTP1
1A5 2B     HIGH2:   LBI     ACTST5
1A6 47              SMB     1
1A7 CC              JP      ALTP2
1A8 2C     HIGH3:   LBI     ACTST6
1A9 47              SMB     1
1AA D1              JP      ALTP3
1AB 08     CYCLE:   LBI     0,9               ;WAIT ONE CYCLE
1AC 00     DEL1:    CLRA                      ;OF 60 HZ
1AD 51     DEL2:    AISC    1
1AE ED              JP      DEL2
1AF 51     DEL3:    AISC    1
1B0 EF              JP      DEL3
1B1 51     DEL4:    AISC    1
1B2 F1              JP      DEL4
1B3 51     DEL5:    AISC    1
1B4 F3              JP      DEL5
1B5 06              X       0
1B6 04              XIS     0
1B7 EC              JP      DEL1
1B8 48              RET
1B9 29     STATS7:  LBI     STATUS
1BA 7F              STII    15
1BB 61BF            JMP     FAULT
1BD 29     STATS6:  LBI     STATUS
1BE 7E              STII    14
1BF 0F     FAULT:   LBI     0,0               ;OFF VALVES
```

```
1C0 333E            OBD
1C2 76              STII    6
1C3 0F              LBI     0,0
1C4 333A            OMG
1C6 3365            LEI     5                   ;OFF IGNITER
1C8 B7              JSRP    STATUP
1C9 C9      HERE:   JP      HERE
0300        .=0300
300 32      AD2:    RC
301 3311            SKGBZ   1
303 22              SC
304 4F              XAS
305 1D      INC2:   LBI     RESL
306 00      LOP2:   CLRA
307 30              ASC
308 44              NOP
309 04              XIS     0
30A C6              JP      LOP2
30B 630D            JMP     AD3
30D 32      AD3:    RC
30E 3311            SKGBZ   1
310 22              SC
311 4F              XAS
312 1D      INC3:   LBI     RESL
313 00      LOP3:   CLRA
314 30              ASC
315 44              NOP
316 04              XIS     0
317 D3              JP      LOP3
318 631A            JMP     AD4
31A 32      AD4:    RC
31B 3311            SKGBZ   1
31D 22              SC
31E 4F              XAS
31F 1D      INC4:   LBI     RESL
320 00      LOP4:   CLRA
321 30              ASC
322 44              NOP
323 04              XIS     0
324 E0              JP      LOP4
325 48              RET
326 1D      ATOD:   LBI     RESL
327 70              STII    0
328 70              STII    0
329 84              JSRP    AD1
32A 84              JSRP    AD1
32B 84              JSRP    AD1
32C 84              JSRP    AD1
32D 84              JSRP    AD1
32E 84              JSRP    AD1
32F 84              JSRP    AD1
330 84              JSRP    AD1
331 84              JSRP    AD1
332 84              JSRP    AD1
333 84              JSRP    AD1
334 84              JSRP    AD1
335 84              JSRP    AD1
336 84              JSRP    AD1
337 84              JSRP    AD1
338 84              JSRP    AD1
339 84              JSRP    AD1
33A 84              JSRP    AD1
33B 84              JSRP    AD1
```

```
519 33C 84              JSRP    AD1
520 33D 84              JSRP    AD1
521 33E 84              JSRP    AD1
522 33F 84              JSRP    AD1
523 340 84              JSRP    AD1
524 341 84              JSRP    AD1
525 342 84              JSRP    AD1
526 343 84              JSRP    AD1
527 344 84              JSRP    AD1
528 345 84              JSRP    AD1
529 346 84              JSRP    AD1
530 347 84              JSRP    AD1
531 348 84              JSRP    AD1
532 349 84              JSRP    AD1
533 34A 84              JSRP    AD1
534 34B 84              JSRP    AD1
535 34C 84              JSRP    AD1
536 34D 84              JSRP    AD1
537 34E 84              JSRP    AD1
538 34F 84              JSRP    AD1
539 350 84              JSRP    AD1
540 351 84              JSRP    AD1
541 352 84              JSRP    AD1
542 353 84              JSRP    AD1
543 354 84              JSRP    AD1
544 355 84              JSRP    AD1
545 356 84              JSRP    AD1
546 357 84              JSRP    AD1
547 358 84              JSRP    AD1
548 359 84              JSRP    AD1
549 35A 84      DELL:   JSRP    AD1
550 35B 84              JSRP    AD1
551 35C 84              JSRP    AD1
552 35D 84              JSRP    AD1
553 35E 84              JSRP    AD1
554 35F 84              JSRP    AD1
555 360 84              JSRP    AD1
556 361 84              JSRP    AD1
557 362 84              JSRP    AD1
558 363 84              JSRP    AD1
559 364 84              JSRP    AD1
560 365 84              JSRP    AD1
561 366 84              JSRP    AD1
562 367 84              JSRP    AD1
563 368 32              RC                          ;RESTORE CAP TO ZERO
564 369 4F              XAS
565 36A 48              RET
566
567
568 36B 0E      FEEDOG: LBI     0,15                ;ON THE XSISTORS
569 36C 333E            OBD
570 36E 19      DEL16M: LBI     DELL1               ;DELAY 16 MSEC
571 36F 7A              STII    10
572 370 7C              STII    12
573 371 19      DEL16:  LBI     DELL1
574 372 22              SC
575 373 00              CLRA
576 374 30              ASC
577 375 44              NOP
578 376 04              XIS     0
579 377 00              CLRA
580 378 30              ASC
581 379 44              NOP
582 37A 04              XIS     0
583 37B 20              SKC
```

```
584 37C F1                JP      DEL16
585 37D 0D                LBI     0,14              ;OFF PILOT
586 37E 333E              OBD
587 380 48                RET
588 381 0C      ONESCV:   LBI     CNTL
589 382 72                STII    2
590 383 7E                STII    14
591 384 7F      TMV:      STII    15
592 385 6B6D    TIMEV:    JSR     FEEDOG
593 387 6B6E              JSR     DEL16M            ;DELAY 16 MSEC
594 389 80                JSRP    TIMER
595 38A C5                JP      TIMEV
596 38B 48                RET
597 38C 0C      TWOSCV:   LBI     CNTL
598 38D 74                STII    4
599 38E 7C                STII    12
600 38F C4                JP      TMV
601                 END
ACTST   0029 *   ACTST4 002B     ACTST5 002C     ACTST6 002D
AD1     0084     AD2    0300     AD3    030D     AD4    031A
ADDLP   0093     ADDLP1 009B     ADLP1  016F     ADRESC 0091
ADRESS  0099     ALTP1  0187     ALTP2  018C     ALTP3  0191
ATOD    0326     CNTL   000D     CONSTH 003F *   CONSTL 003E
COPY3   0059     COUNT  0009     CYCLE  01AB     DECTM  005D *
DEL     0039 *   DEL1   01AC     DEL16  0371     DEL16M 036E
DEL2    01AD     DEL3   01AF     DEL4   01B1     DEL5   01B3
DELL    035A *   DELL1  001A     DELTAH 000F     DELTAL 000E *
FAULT   01BF     FEEDOG 036B     FLMQ   0140     GPORT  0019
HERE    01C9     HIGH1  01A2     HIGH2  01A5     HIGH3  01A8
IGNOK   0100     INC1   0089 *   INC2   0305 *   INC3   0312 *
INC4    031F *   INIT   000D     LOP1   008A     LOP2   0306
LOP3    0313     LOP4   0320     LPORT  000A *   NXT1   0131
NXT2    0136     OFFGAS 013C     OK2    012D     ONESCV 0381
ONESEC  0156     PILTOK 001C *   PURGE  0025     Q1     00A3
Q2      00AE     RESH   001F *   RESL   001E     RETEST 0147
RSGCNS  00A1     RSGSTK 00AC     SECOND 003D     STAT7  014F
STATS1  000F     STATS2 0020     STATS3 002C     STATS4 0115
STATS5  004B     STATS6 01BD     STATS7 01B9     STATUP 00B7
STATUS  002A     STKH   002F *   STKL   002E     T12    001C *
TENSEC  0165     TEST   001B     TIMCNT 003A     TIME   015A
TIMER   0080     TIMER1 016D     TIMEV  0385     TLP    0180
TM      0159     TM1    016E *   TMV    0384     TSTAC  0082
TSTAC1  0178     TSTG   0047     TSTGAS 003C *   TURNON 0052
TWOSCV  038C     TWOSEC 0160     WAITLP 0017 *

NO ERROR LINES

  534  ROM WORDS USED

COP   420  ASSEMBLY

SOURCE CHECKSUM = 9ECC

INPUT FILE     CHOP:FURE.SRC  VN:    2

LISTING FILE   CHOP:FURE.LST
```

Figure 4:
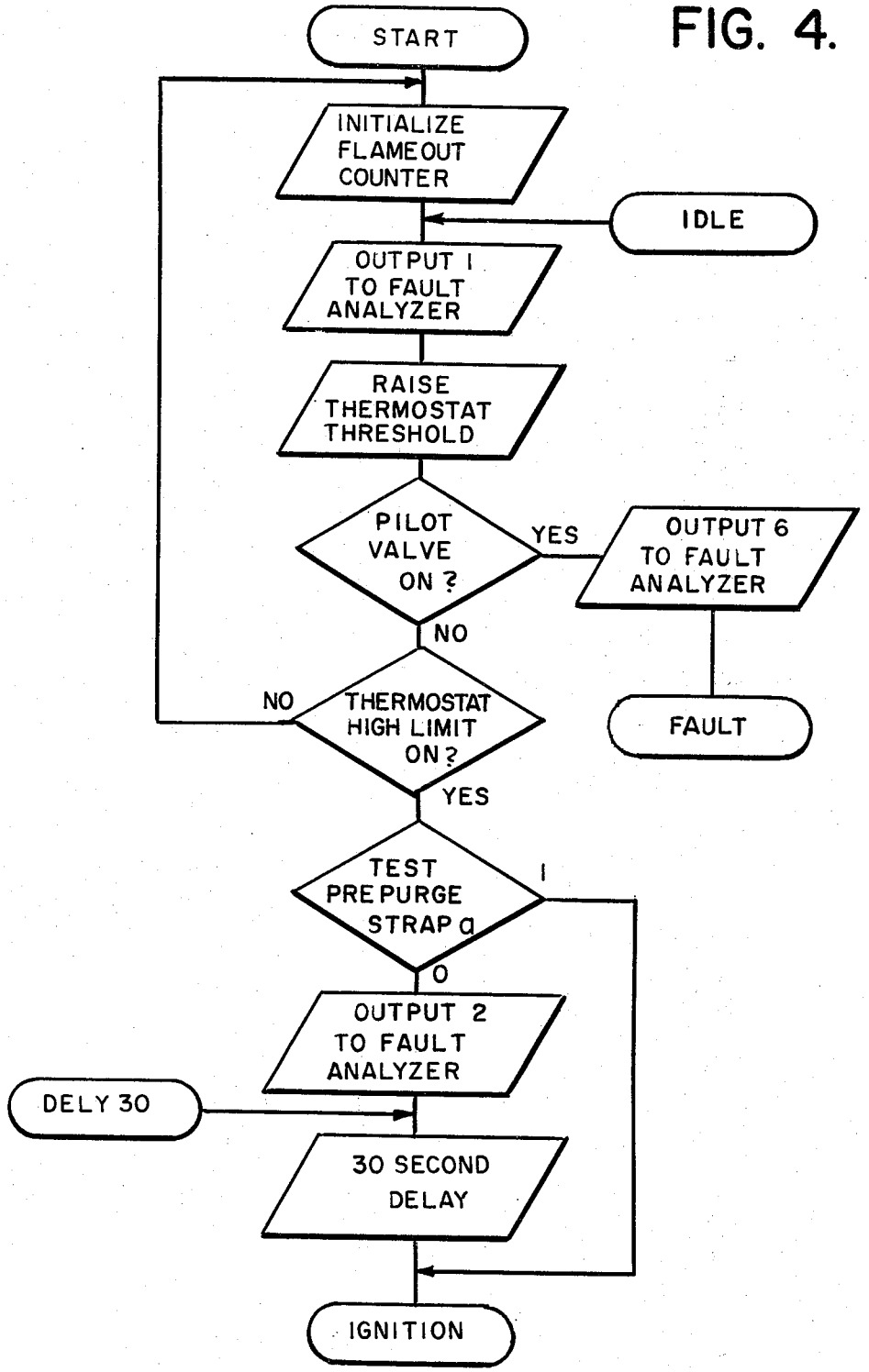
FIGS. 4–9 are system logic flow diagrams for the preferred system.

The operation of the system 10 will now be described with particular reference to the flow charts illustrated in FIGS. 4–9. In describing the operation of the system 10, it will be assumed that the flame is initially off. In this state, the microcomputer 12 maintains the system 10 in an IDLE mode (FIG. 4). In the IDLE mode, the microcomputer 12 continuously monitors the pilot valve relay driver input as well as the input connected to the thermostat 24 and high limit switch 26. As shown in FIG. 3, the thermostat 24 and high limit switch 26 are connected in series to a single input of the microcomputer 12.

As is apparent from FIG. 4, the microcomputer 12 maintains the system 10 in the IDLE mode until either the pilot valve relay driver fails shorted or the thermostat/high limit input becomes active, i.e. calls for heat. If the pilot relay shorts, the microcomputer 12 will enter a FAULT mode. The operation of the system 10 in the FAULT mode will be explained in greater detail hereinafter.

As shown, the microcomputer 12 is preferably programmed to establish a predetermined thermostat threshold current which must be exceeded before the microcomputer will attempt ignition. For example, a current threshold of 100 milliamperes may be set. This is done to accommodate programmable setback thermostats which "steal" current from the power circuit that might otherwise provide a false ignition signal to the microcomputer.

Figure 5:
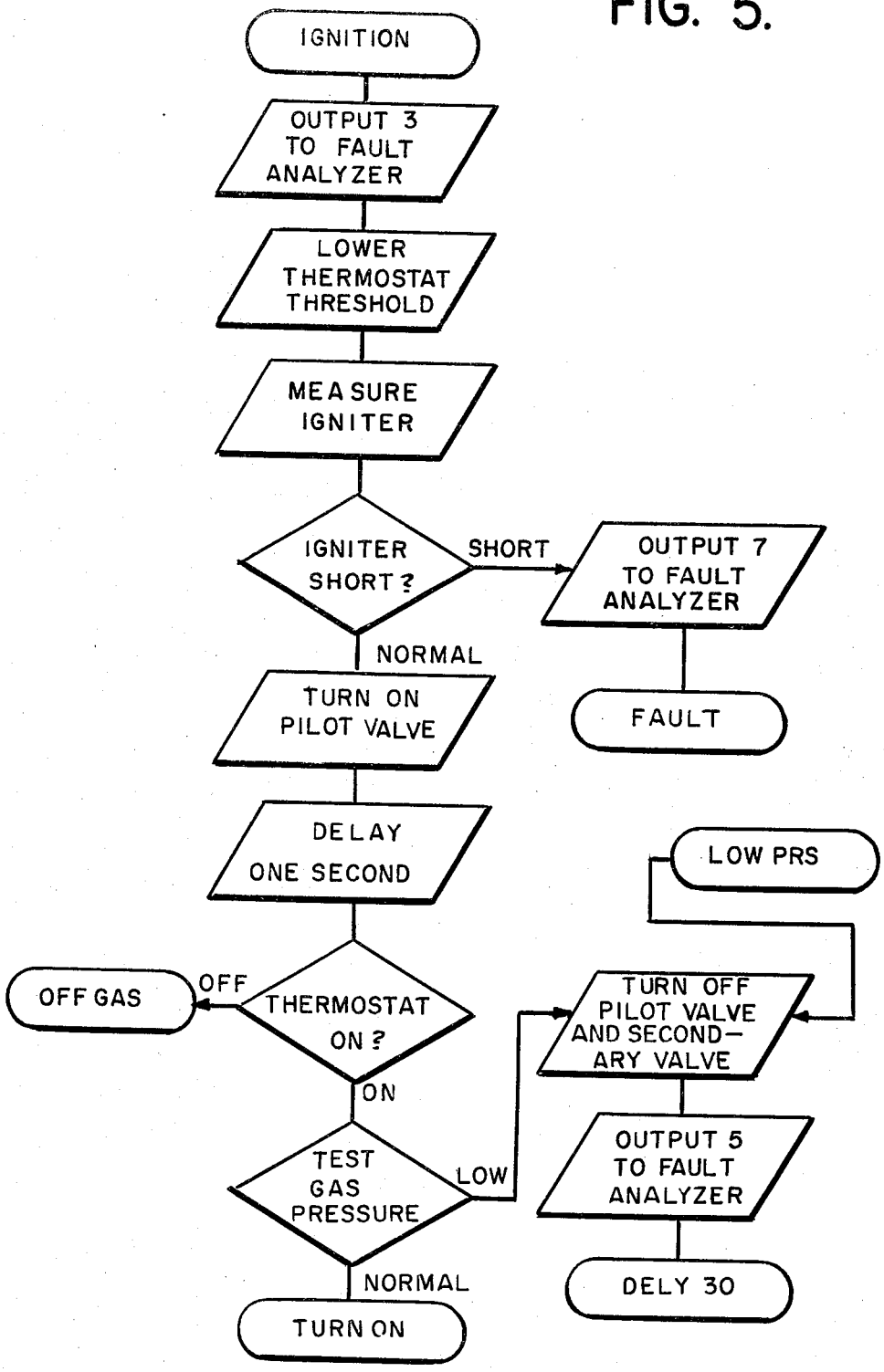

Assuming no fault occurs and the thermostat calls for heat, the microcomputer 12 effects a prepurge delay during which commencement of the ignition sequence is delayed for preferably thirty seconds. At the expiration of the thirty second delay, the microcomputer 12 enters the IGNITION mode (FIG. 5). Upon entering the IGNITION mode, the microcomputer 12 reduces the thermostat threshold current and then tests the igniter element 17 for a short by measuring its resistance. If the igniter element 17 is shorted, the microcomputer 12 enters the FAULT mode. Assuming no fault, the microcomputer activates the pilot valve relay driver circuit thereby opening the pilot valve 58. After a preferably one second delay, the microcomputer 12 again monitors the thermostat/high limit input. If the thermostat/high limit input is open, thereby indicating that heat is no longer called for, the microcomputer 12 enters the OFFGAS mode. As will be more fully apparent from the description of FIG. 8 below, when the system enters the OFFGAS mode, the microcomputer, after a ten second delay, returns to the IDLE mode whereupon the pilot valve 58 is closed. Assuming the thermostat/high limit input is still active, the microcomputer 12 next checks the gas pressure by monitoring the pressure sensitive switch 22. If gas pressure is normal, gas flow through the pilot valve 58 into the conduit 70 and connected chamber 72 will move diaphragm 74 upward until the conducting element 76 makes contact with the contacts 78, 80 thereby closing the circuit to the microcomputer 12. If the microcomputer 12 detects that the contacts 78, 80 are open, the microcomputer enters a LOWPRS mode. The operation of the system 10 in the LOWPRS mode will be explained in greater detail below. Assuming gas pressure is verified, the microcomputer 12 enters the TURNON mode.

Figure 6:
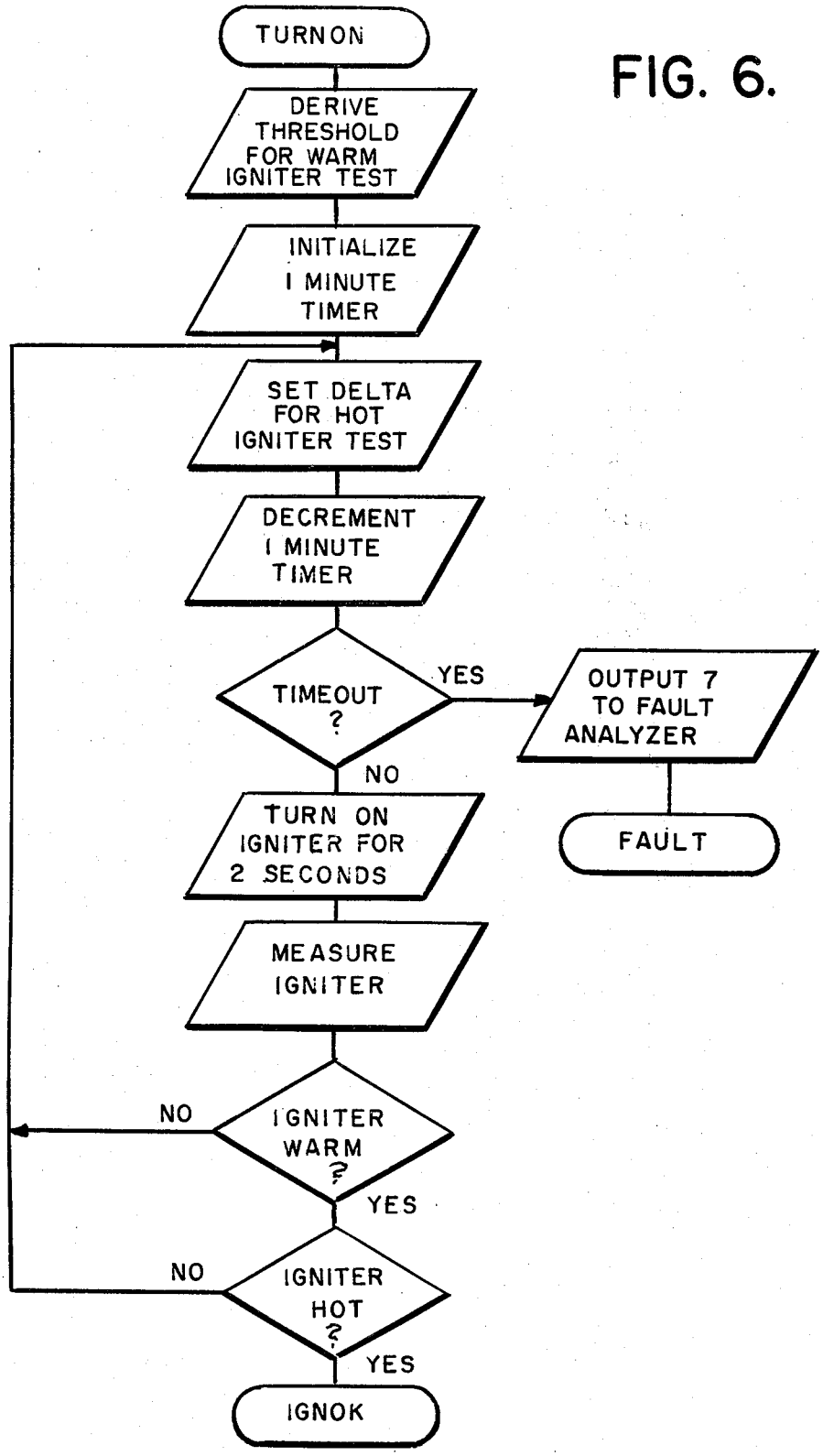

At this point the microcomputer 12 readies the system 10 for gas ignition. This requires activating the igniter element relay driver circuit to energize the igniter element 17 and then opening gas flow to the burner 14 when the igniter element is sufficiently hot to effect gas ignition. As previously noted, to determine whether a particular igniter element has reached ignition temperature, the microcomputer 12 must be capable of distinguishing between different elements having different temperature characteristics. As shown in FIG. 6, to determine whether the element 17 has reached ignition temperature, the microcomputer 12 conducts two tests—the "warm" test and the "hot" test. First, the microcomputer establishes a threshold based on the resistance of the element 17 before the igniter 16 is energized, i.e. when the element 17 is still cold. The igniter 16 is then energized for preferably two seconds and the resistance of the element 17 again measured. If the resistance reading is below the threshold, the warm test is passed. If the warm test is not passed, the igniter 16 is again energized for preferably two seconds, the resistance of the element 17 is measured, and the new reading is compared to the reference cold reading. This process continues until either the warm test is passed or preferably one minute elapses. If the warm test is not passed after one minute, the microcomputer 12 enters the FAULT mode.

Assuming the warm test is passed, the microcomputer 12 next conducts the hot test. In this test, the microcomputer compares two consecutive resistance measurements of the element 17. If the difference between these readings is less than a predetermined value, the hot test is passed, as this indicates that the flat, i.e. high temperature, portion of the temperature characteristic for the element 17 has been reached. If the hot test is not passed, the element 17 is again energized for preferably two seconds, whereupon both the warm and hot tests are again conducted. This continues until the hot test is passed or until the one minute period expires. If the hot test is not passed within one minute, the microcomputer 12 enters the FAULT mode. By utilizing the above technique to confirm ignition temperature, ignition is achievable despite reduced line voltage.

When ignition temperature is confirmed, the microcomputer 12 enters the IGNOK mode (FIG. 7) whereupon the secondary valve relay driver is activated to open the secondary valve 60. Simultaneously, the element 17 is energized. At this point, gas flows through the chamber 66 and the metered orifice 68 into the burner 14 whereupon the gas is ignited as it passes through the apertures 40 in the vicinity of the element 17. Preferably four seconds later, the element 17 is deenergized.

Figure 7:
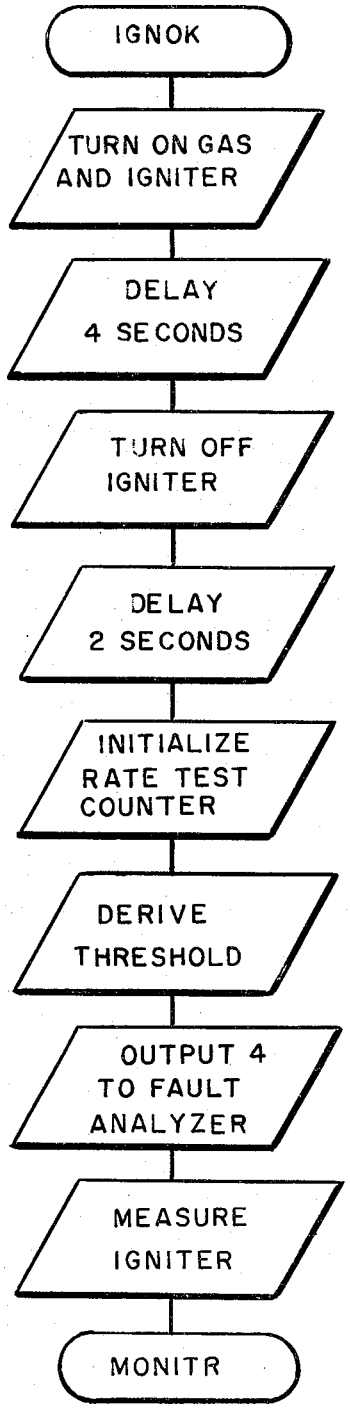
Figure 8:
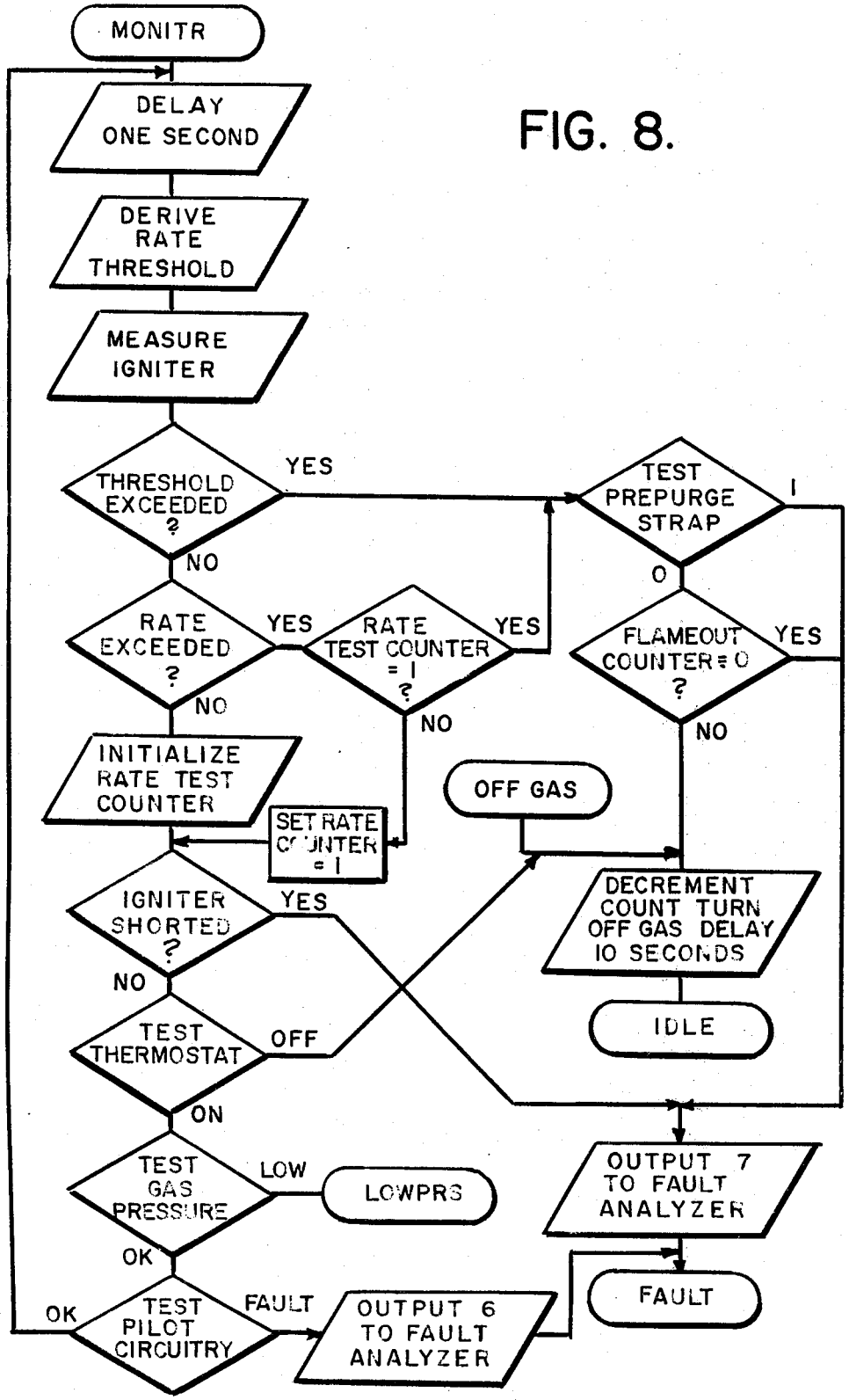

At this point, the element 17 is utilized as a heat detector. To this end, the microcomputer 12 monitors the resistance of the element 17 for the presence or absence of a flame. As will be explained below, if a flameout occurs, the microcomputer is programmed for corrective action. For the microcomputer 12 to determine whether a flameout has occurred based on the resistance of the element 17, the microcomputer 12 must be capable of compensating for variations in the temperature characteristics of different igniter elements. To determine if a flameout occurs, the microcomputer 12 conducts two tests—a level test and a rate test. Referring to FIGS. 7 and 8, preferably two seconds after the igniter is deenergized the microcomputer 12 establishes a threshold resistance based on the measured resistance of the igniter element 17 just prior to ignition, i.e. when the igniter element is hot. The threshold resistance is preferably equal to the measured resistance increased by a predetermined value. That is, the threshold resistance is established such that if the resistance of the element 17 exceeds the threshold, this will indicate that the temperature in the vicinity of the element 17 has dropped sufficiently to confirm the occurrence of a flameout. The rate test is accomplished by comparing the rate of change of the resistance of the igniter element 17 with a preestablished rate. As preferred and shown in FIG. 8, if the rate of change of the igniter element resistance exceeds the preestablished rate twice in a row, thereby indicating a continuing drop in temperature in the vicinity of the igniter element, this too establishes a flameout.

In the event of a flameout, the microcomputer 12, after a ten second delay, returns to the IDLE mode. Assuming the thermostat 24 is still calling for heat, the microcomputer then repeats the ignition sequence described hereinabove in an effort to again ignite the flame. If flameout occurs three times in a row, as indicated by the flameout counter, the microcomputer 12 enters the FAULT mode.

When the microcomputer is in the MONITOR mode (FIG. 8), the microcomputer 12, in addition to monitoring the flame, also continuously monitors the igniter element 17, the thermostat/high limit input, the input from the pressure switch 22, and the pilot relay driver circuitry. As shown in FIG. 8, if the igniter element 17 shorts or the pilot valve relay driver circuitry fails, the microcomputer 12 enters the FAULT mode. If either the thermostat 24 or high limit switch 26 opens, the microcomputer 12 returns the system to the IDLE mode (FIG. 4) thereby closing the pilot valve 58 and shutting the flame. If the switch 22 opens, thereby indicating that gas pressure is low, the microcomputer enters the LOWPRS mode (FIG. 5).

In the LOWPRS mode, the microcomputer 12 closes the pilot and secondary valves 58, 60. As shown in FIGS. 4 and 5, after a thirty second delay, the microcomputer 12 then enters the IGNITION mode whereupon the microcomputer 12 runs through the ignition sequence more fully described above. This sequence concludes with a gas pressure check. As long as the pressure remains low, this sequence is repeated. As shown, when the switch 22 closes, thereby indicating that gas pressure has been restored, the microcomputer 12 enters the TURNON mode. Operation of the system 10 in the TURNON mode is more fully discussed above.

Figure 9:
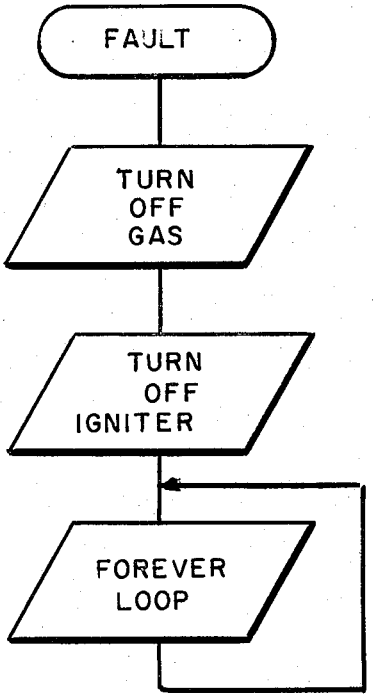

As is described above, the microcomputer 12 enters the FAULT mode in response to a malfunction, e.g. if the igniter element 17 fails shorted or open, the pilot valve relay driver circuitry shorts, three consecutive flameouts occur, etc. The flow chart for the FAULT mode is illustrated in FIG. 9. As shown, in the FAULT mode the pilot valve 58 and secondary valve 60 are closed to turn off the gas flow, and the igniter element 17 is deenergized. Assuming the external power source remains operative, these conditions will prevail until the reset switch 36, which preferably comprises a push button switch, is depressed, whereupon the microcomputer 12 is returned to START (FIG. 4). Of course, if the fault persists, the microcomputer 12 will re-enter the FAULT mode when the microcomputer again checks the faulty component. Whenever the system enters the FAULT mode, the indicator light 34 lights thereby visually indicating the presence of a fault. However, the light 34 may not light if the system 10 is completely down, which may result from a total loss of power.

In the event of a fault, it is preferable to provide means for indicating the nature of the fault. This function is accomplished by the plug-in fault analyzer 28 which also indicates the status of the system 10. The analyzer 28 is presently contemplated for use by service personnel. As previously noted, the analyzer 28 incorporates a conventional seven segment digital display 84. Referring to FIGS. 1 and 3, the self-powered analyzer 28 is connected to the microcomputer 12 by plugging the analyzer into the receptacle 82. The number on the digital display 84 then indicates the type of fault or a particular system status. In the above described preferred system 10, and referring to FIGS. 4–9, a reading of zero indicates that the power level is insufficient to operate the system, a reading of one indicates that the system is in the IDLE mode, a reading of two indicates that the thermostat/high limit input is active, a reading of three indicates that the system is in the IGNITION mode, a reading of four indicates that the system is in the IGNOK mode, a reading of five indicates that the gas pressure is low, a reading of six indicates that the pilot valve is improperly open in the IDLE mode, and a reading of seven indicates an igniter malfunction.

To accommodate particular applications, the preferred system 10 preferably incorporates means for modifying the functioning of microcomputer 12 for altering the mode of operation described above. Referring to FIG. 3, the functioning of the microcomputer 12 is preferably modifiable by ungrounding specific inputs to the microcomputer provided for this purpose. As shown in FIG. 3, such ungrounding is preferably accomplished by providing a removable conductive member ("strap a" in FIG. 3) which connects the input to ground. The conductive member is preferably factory installed and forms part of the interfacing circuitry within the housing 32. When strap a is removed, the mode of operation described above is modified as shown in the flow chart, FIGS. 4–9. Specifically, when strap a is removed, the thirty second prepurge delay before the microcomputer 12 enters the ignition mode is bypassed (see FIG. 4). This modification would be used, for example, where immediate heat is required. When strap a is removed, the microcomputer also preferably enters the FAULT mode in response to a single flameout, as opposed to three flameouts (FIG. 8). This prevents the accumulation of gas which might otherwise occur if ignition is attempted three times without a thirty second delay between attempts. If desired, the microcomputer may be programmed for still other options which would take effect upon removal of other straps not shown.

Throughout the specification and claims, reference is made to measuring the resistance of the igniter element 17 for determining the temperature characteristic thereof. Those skilled in the art will appreciate, however, that the relevant information may be obtained not only by actuatlly measuring the resistance of the igniter element, but also by measuring the current flow through the igniter element or the voltage drop across the igniter element. Accordingly, the phrase "measuring the resistance" or like phrases, when applied to the igniter element, should be understood throughout as contemplating current or voltage measurements which also yield information defining the temperature characteristic of the igniter. In the preferred system 10 described above, information defining the temperature characteristic of the igniter element is obtained by measuring the voltage drop across the igniter element.

While I have herein shown and described the preferred embodiment of the present invention and have suggested certain modifications thereto, it will be apparent that further changes and modifications may be made without departing from the spirit and scope of the invention. Accordingly, the above description should be construed as illustrative and not in the limiting sense, the scope of the invention being defined by the following claims.

We claim:

1. An improved automatic fuel ignition system for gas fired devices having a burner provided with an outlet, a power source, a first normally closed fuel valve for controlling the gas flow to said burner, and means for opening said valve, said system being of the type including a variable resistance ignition means having a particular temperature characteristic disposed in proximity to said burner outlet for igniting gas flowing therethrough when said ignition means is energized by operative connection to said power source, the improvement comprising:

detection means for repeatedly measuring the resistance of said variable resistance ignition means at predetermined intervals and for comparing said measurements; and activating means operatively connected to said detection means and said valve opening means for activating said valve opening means to open said valve when the difference between measurements establishes that said variable resistance ignition means is in the portion of its temperature characteristic where the temperature thereof is sufficient to ignite said gas.

2. The automaic fuel ignition system according to claim 1, wherein said detection means and said activating means comprise a microcomputer.

3. The automatic fuel ignition system according to claim 2, wherein said detection means comprises means for (a) measuring the resistance of said ignition means before energization thereof, (b) repeatedly measuring the resistance of said ignition means at predetermined intervals after energization thereof, (c) comparing said preenergization measurement with said post-energization measurements until the difference therebetween is greater than a predetermined minimum thereby indicating that said ignition means is increasing in temperature and (d) comparing successive post-energization measurements until the difference between successive measurements is less than a predetermined maximum threshold thereby confirming that the temperature of said ignition means is sufficient to ignite said gas.

4. The automatic fuel ignition system according to claim 3, wherein said system includes indicating means operatively connected to said microcomputer for indicating that said predetermined minimum threshold has not been exceeded within a predetermined time interval or that said successive measurements are not less than said predetermined maximum threshold within a predetermined time interval.

5. The automatic fuel ignition system according to claim 4, wherein said microcomputer further comprises:

means for deenergizing said ignition means a predetermined interval after said fuel valve is opened; and means for detecting a flameout.

6. The automatic fuel ignition system according to claim 5, wherein said flameout detection means comprises means for (a) measuring the resistance of said ignition means prior to deenergization thereof, (b) repeatedly measuring the resistance of said ignition means after deenergization thereof, (c) comparing the difference between said predeenergization measurement and each post-deenergization measurement with a second predetermined threshold whereby if said threshold is exceeded a flameout is confirmed, and (d) comparing successive post-deenergization resistance measurements and determining if the rate of change of the resistance of said ignition means exceeds a preselected rate a predetermined number of times thereby confirming a flameout.

7. The automatic fuel ignition system according to claim 6, wherein said indicating means further comprises means operatively connected to said microcomputer for indicating that said flameout detection means has confirmed a flameout.

8. The automatic fuel ignition system according to claim 7, further comprising means for confirming that gas pressure is above a predetermined level, said means comprising:

a branch conduit in the flow path to said burner, a pair of spaced electrically conductive contacts at one end of said conduit, a conductive member movably supported in said conduit for movement towards said one end under the influence of said gas pressure when said gas pressure is above said predetermined level, and away from said one end under the influence of gravity when said gas pressure is below said predetermined level, said conductive member establishing an electrically conductive path between said contacts when said conductive member is moved to said one end of said conduit; and said microcomputer including means for confirming that said conductive member has established an electrically conductive path between said contacts.

9. The automatic fuel ignition system according to claim 8, wherein said indicating means further comprises means operatively connected to said microcomputer for indicating that said conductive member has not established an electrically conductive path between said contacts.

10. The automatic fuel ignition system according to claim 9, further comprising an additional fuel valve in series with said first fuel valve on the inlet side thereof, and means for opening said additional fuel valve, and wherein said branch conduit is disposed between said fuel valves, and said microcomputer further comprises means for activating said additional valve opening means for verifying that said gas pressure is above said predetermined level prior to activating said first valve opening means.

11. The automtic fuel ignition system according to claim 10, wherein said microcomputer further comprises means for detecting whether said ignition means is functional, and wherein said indicating means further comprises means operatively connected to said microcomputer for indicating that said ignition means is non-functional.

12. The automatic fuel ignition system according to claim 11, wherein said microcomputer includes means for detecting whether said additional fuel valve opening means is functional, and wherein said system includes means for indicating that said additional fuel valve opening means is non-functional.

13. The automatic fuel ignition system according to claim 12, wherein said microcomputer includes means for deenergizing said ignition means and deactivating said additional valve opening means if (a) said predetermined minimum threshold is not exceeded within a predetermined time interval, or (b) two successive resistance measurements are not less than said predetermined maximum threshold within a predetermined time interval, or (c) a flameout is confirmed, or (d) said conductive member has not established an electrically conductive path between said contacts when said additional valve means is open, or (e) said ignition means is non-functional.

14. The automatic fuel ignition system according to claim 13, wherein said indicating means comprises means for providing a visual signal.

15. The automatic fuel ignition system according to claim 14, wherein said visual signal providing means comprises a light.

16. The automatic fuel ignition system according to claim 14, wherein said visual signal providing means comprises means removably connectable to said microcomputer and having visible indicia thereon selectively activatable by said microcomputer for identifying whether (a) said predetermined minimum threshold has not been exceeded within a predetermined time interval, or (b) two successive resistance measurements have not been less than said predetermined maximum threshold within a predetermined time interval, or (c) a flame-out has been confirmed, or (d) said conductive member has not established an electrically conductive path between said contacts when said additional valve means is open, or (e) said ignition means is non-functional.

17. The automatic fuel ignition system according to claim 13, wherein said system further comprises a thermostat operatively connected to said microcomputer, and wherein said microcomputer further comprises means for operatively connecting said ignition means to said power source when said thermostat is activated.

* * * * *